United States Patent [19]

Watanabe

[11] Patent Number: 4,521,201

[45] Date of Patent: Jun. 4, 1985

[54] STEERING DEVICE FOR AN OUTBOARD MOTOR

[75] Inventor: Eifu Watanabe, Hamamatsu, Japan

[73] Assignees: Yamaha Hatsudoki Kabushiki Kaisha; Sanshin Kogyo Kabushiki Kaisha, both of Japan

[21] Appl. No.: 467,304

[22] Filed: Feb. 17, 1983

[30] Foreign Application Priority Data

Feb. 22, 1982 [JP] Japan ..... 57-26140

[51] Int. Cl.[3] ..... B63H 25/02

[52] U.S. Cl. ..... 440/55; 440/63; 74/495; 74/527; 114/144 R

[58] Field of Search ..... 440/55, 63; 114/172, 114/144 R; 74/495, 527

[56] References Cited

U.S. PATENT DOCUMENTS

| | | | |
|---|---|---|---|
| 1,452,900 | 4/1923 | Turner | 74/527 |
| 1,593,823 | 7/1926 | Gleason | 440/55 |
| 2,182,596 | 12/1939 | Olsen | 74/495 |
| 2,221,101 | 11/1940 | Lefkowitz | 74/527 |
| 2,426,001 | 8/1947 | Denault | 74/527 |
| 2,846,896 | 8/1958 | Allen | 74/495 |
| 3,164,039 | 1/1965 | Abbey | 74/527 |
| 3,310,021 | 3/1967 | Shimanckas . | |
| 3,463,032 | 8/1969 | Murphy | 74/495 |

*Primary Examiner*—Trygve M. Blix
*Assistant Examiner*—Thomas J. Brahan
*Attorney, Agent, or Firm*—Ernest A. Beutler

[57] ABSTRACT

A steering device for an outboard motor that releasably restrains the motor in a predetermined position and which can be automatically released upon the exertion of more than a predetermined force to the motor to steer it in the event of an emergency. The releasable restraining device is also automatically engageable upon return of the motor to its first position and can be manually released.

7 Claims, 4 Drawing Figures

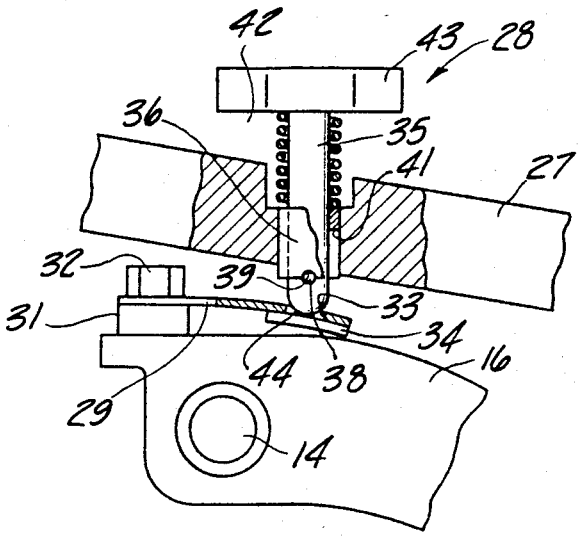
Fig-2
Fig-3
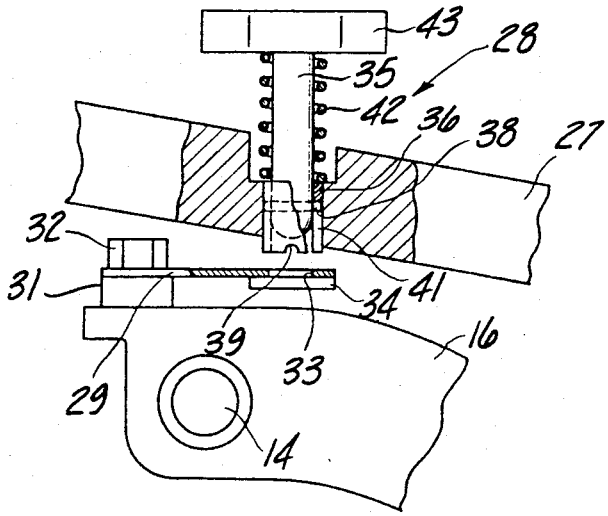

STEERING DEVICE FOR AN OUTBOARD MOTOR

BACKGROUND OF THE INVENTION

This invention relates to a steering device for an outboard motor and more particularly to a releasable restraining device for retaining the motor in a fixed steering condition.

As is well known, outboard motors normally include a swivel bracket that is affixed for tilting movement relative to the transom of the boat and which supports the power head and drive unit for steering movement about a generally vertically extending steering axis. Normally a handle or tiller is affixed to the power unit for steering movement. In many instances, it is desirable to provide an arrangement for retaining the steered components in a set position. Normally, it is desirable to provide some arrangement for retaining the motor in a position so that the boat will travel in a straight ahead direction without requiring constant attention from the operator. That is, it is desirable if the motor can be provided with some arrangement for holding it in position so that an operator need not continually have his hand on the tiller. If some form of retaining mechanism is provided so as to hold the motor in the straight ahead position, it is extremely important to provide an arrangement wherein the operator may quickly steer the motor in the event of an emergency situation without the necessity of separately releasing the steering retaining arrangement. Because of the somewhat inconsistent requirements of providing positive retention and also immediate release, previously proposed mechanisms for achieving these results have not been wholly satisfactory.

It is, therefore, a principal object of this invention to provide an improved sterring system for an outboard motor or the like.

It is another object of this invention to provide an outboard motor steering system wherein the motor is releasably restrained in a predetermined steering condition.

It is another object of the invention to provide an outboard motor steering arrangement wherein the motor may be fixed in a predetermined steered condition but which facilitates automatic release and free steering in other conditions.

SUMMARY OF THE INVENTION

A first feature of this invention is adapted to be embodied in a steering device for an outboard motor or the like comprising a first member that is adapted to be affixed to a vessel and a second member that is journalled for steering movement relative to the first member about a steering axis. In accordance with this feature of the invention, releasable means releasably restrain the second member against steering movement relative to the first member. The releasable means comprises a pair of positively interengaging elements that cooperate to prevent the steering movement upon the exertion of normal forces to the second member and which will release their positive engagement to permit steering movement of the second member relative to the first member upon the exertion of a force greater than a normal force.

Another feature of the invention is also adapted to be embodied in a steering device having a first member and a second member that is journaled for steering movement relative to the first member. In accordance with this feature of the invention, restraining means are provided that are effective to restrain the second member against steering movement relative to the first member when the second member is only in a predetermined position.

Yet another feature of the invention is also adapted to be embodied in a steering device for an outboard motor or the like including first and second relatively journalled members. In accordance with this feature of the invention, releasable means are provided for restraining the second member against steering movement relative to the first member in a first position and which is automatically reengaged upon return of the second member to that first position after it has been steered.

BRIEF DESCRIPTION OF THE DRAWINGS

FIG. 2 is an enlarged, side elevational view of the restraining mechanism of the motor in its engaged position, with portions shown in section.

FIG. 3 is an enlarged, partially sectional view, in part similar to FIG. 2, showing the restraining mechanism in a released condition.

DETAILED DESCRIPTION OF THE PREFERRED EMBODIMENT OF THE INVENTION

Figure 1:
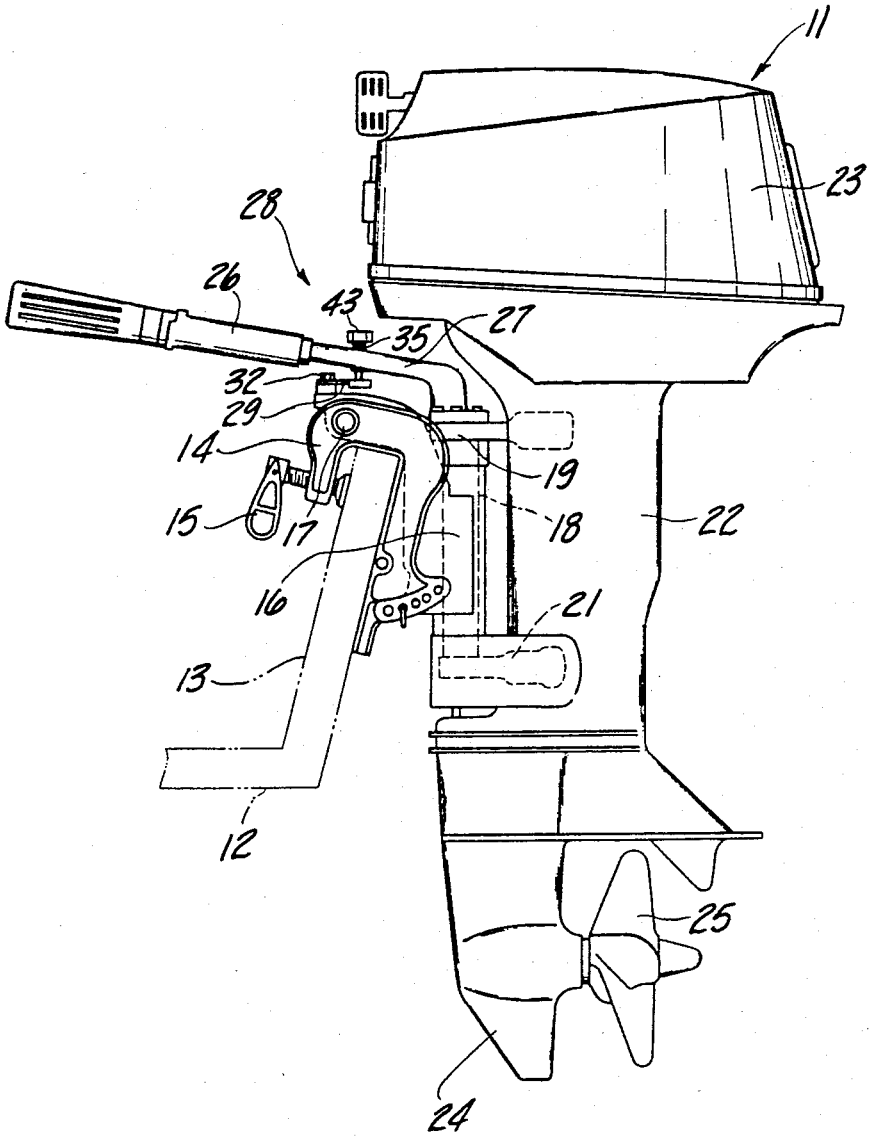
FIG. 1 is a side elevational view of an outboard motor constructed in accordance with an embodiment of this invention.
Figure 4:
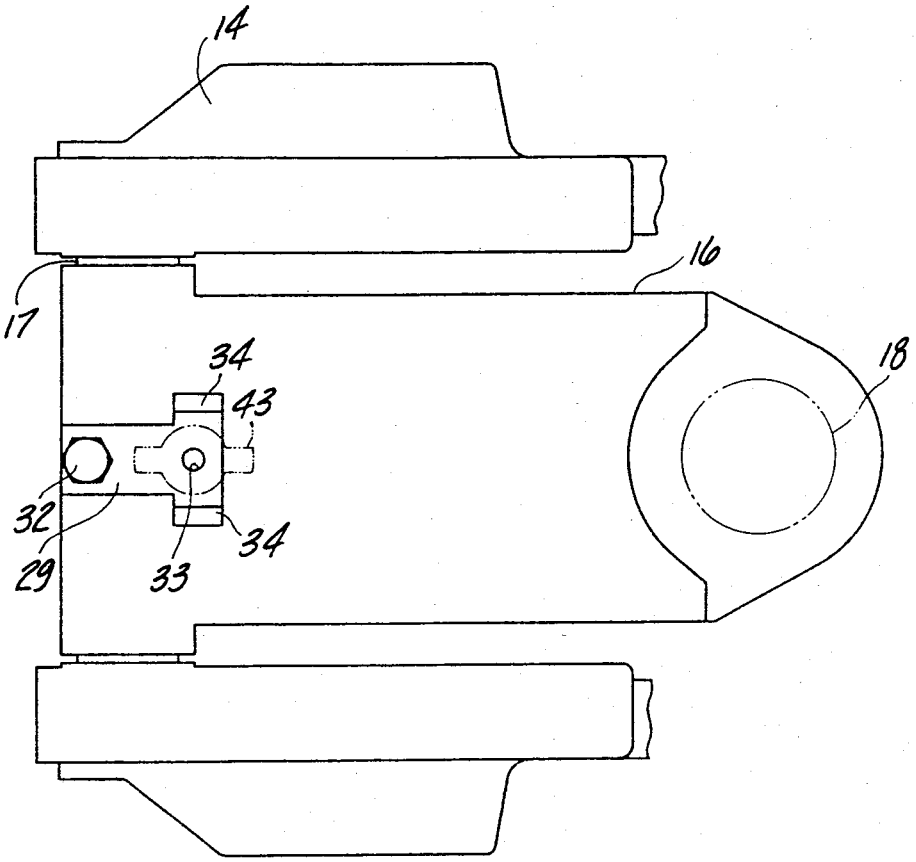
FIG. 4 is an enlarged, top plan view of the swivel bracket employed in the illustrated embodiment.

Referring first to FIG. 1, an outboard motor having a steering arrangement constructed in accordance with an embodiment of the invention is identified generally by the reference numeral 11. The motor 11 is adapted to be affixed to the stern of a boat, shown in phantom, and identified by the reference numeral 12 and particularly to the boat transom 13. For this purpose, a clamping bracket assembly, indicated generally by the reference numeral 14, is provided with a pair of screw-like clamps 15 that affix the bracket 14 to the transom 13 in a known manner. A swivel bracket 16 is supported for pivotal movement about a substantially horizontally extending tilt axis upon the clamping bracket 14 by means of one or more pivot pins 17.

The swivel bracket 16 journals a steering shaft 18 of the motor 11 in a known manner. This arrangement includes a steering bracket 19 and lower bracket 21 to which a drive shaft housing 22 of the motor 11 is affixed in a known manner. The upper end of the drive shaft housing 22 carries the power head 23 that consists of an outer cowling and internal combustion engine. Depending from the drive shaft housing 22 is a lower unit 24 in which a propeller 25 is journalled.

The steering shaft 18 and, accordingly, power head 23, drive shaft housing 22 and lower unit 24 are rotated for steering movement about a generally vertically extending axis defined by the steering shaft 18 by means of a tiller 26. The tiller 26 consists of a generally forwardly extending handle having a base portion 27 that is affixed to the steering bracket 19 in a known manner.

The construction of the motor 11 as thus far described is conventional. For this reason, various details of its arrangement and operation have not been given because they are believed to be obvious and well known to those skilled in the art. In accordance with the invention, a device, indicated generally by the reference numeral 28, is provided for retaining the motor 11 in a predetermined steering condition. Normally, the device 28 will be employed for releasably restraining the motor 11 in a condition that the associated boat is propelled forwardly without any change in its direction of travel.

A device 28 includes a cantilevered leaf spring 29 that is affixed at one of its ends to a boss 31 on the swivel bracket 16 by means of a bolt 32. The spring 29 has a generally T shape configuration at its other end and is formed with a central cylindrical hole 33. On either side of the hole 33, the leaf spring 29 is provided with downwardly extending bent projecting ends 34.

A locking member, comprising a detent pin 35 is adapted to cooperate with the leaf spring hole 33 so as to retain the motor 11 in a predetermined position. The detent pin 35 has a cylindrical shank portion of slightly larger diameter than the hole 33. The pin 35 is slidably supported within a bushing 36 that is pressed into a bore 37 formed in the tiller handle portion 27. The lower end of the detent pin 35 is provided with a cross pin 38 that is adapted to cooperate with either a pair of aligned cylindrical recesses 39 formed in the ends of the lower portion of the bushing 36 or a pair of elongated slots 41 that extend at right angles to a plane containing the recesses 39.

A coil compression spring 42 encircles the upper end of the detent pin 35 and engages the tiller end 27 and a projecting knob 43 that is affixed to the upper end of the detent pin 35. Spring 42 normally urges the detent pin 35 to a released position, as will become apparent.

FIG. 3 shows the device 28 in a released condition so that the motor 11 may be steered freely from the tiller 26. In this position, the detent pin 35 is rotated so that its pin 38 will extend into the elongated slots 41 under the action of the spring 42. The pin 35 is, thus, free of the leaf spring opening 33 and the motor may be freely steered.

If the operator desires to retain the motor 11 in a position so that the boat will travel forwardly, he may engage the device 28 so as to restrain the motor in this condition. This is done by pressing downwardly on the knob 43 sufficiently so that the spring 42 will be compressed and the pin 38 will move free of the slots 41. A rounded end 44 of the detent pin 35 will then enter the opening 33 and deflect the spring 29 slightly (FIG. 2). When the rounded end 44 enters the opening 33, the knob 43 is rotated so that the pin 38 will register with the notches 39. The pin 35 will thus be held in the engaged position as shown in FIG. 2 and the operator may leave his hands free of the tiller.

As may be seen from FIG. 2, it is only the rounded end portion 44 of the pin 35 that enters the leaf spring opening 33. The force of the leaf spring 29 is sufficient to hold the motor 11 and specifically the power head 23, drive shaft housing 22 and lower unit 24 against steering rotation about the shaft 18 under normal loadings encountered due to engine vibration and water resistance when traveling in a straight ahead direction. However, in the event of an emergency, the operator may steer the motor without releasing the device 28. This is accomplished by applying sufficient force to the tiller 26 so as to cause the rounded end 44 of the pin 35 to cam itself out of the opening 33 through deflection of the lead spring 29. The motor may then be steered without any interference from the device 28.

If the device 28 is retained in its latched position as shown in FIG. 2 and the motor 11 is returned to the straight ahead position, the rounded end 44 will contact either of the downwardly turned tabs 34 at one side of the spring 29, depending on which way the motor has been steered, and the rounded end 44 may again enter the opening 33 when the motor 11 is positioned at its straight ahead running condition. Thus, the device 28 will be automatically reengaged without necessitating any actuation by the operator.

Of course, the device 28 can be released at any time by pressing the knob 43 downwardly against the action of the spring 42 and rotating the pin 35 so that its pin 38 will enter the elongated slots 41. The spring 42 will then return the device 28 to its released position as shown in FIG. 3.

It should be readily apparent from the foregoing description that the described device 28 conveniently permits a motor to be retained in a predetermined steering position without the operator maintaining his hand on the tiller. However, the device is constructed in such a way that in the event an emergency arises, the operator may immediately steer the motor without releasing the device 28. This steering motion is also accomplished without any resistance from the device 28 once its initial position is overcome. The device also automatically reengages upon return of the tiller to the predetermined steering position. Of course, the device can be manually released if desired in addition to its emergency release operation. Although in the illustrated embodiment the detent pin is carried by the tiller and the leaf spring is carried by the swivel bracket, the elements may be reversed. Also, they may be mounted on other components of the engine and its supporting arrangement. Various other changes and modifications may be made without departing from the spirit and scope of the invention, as defined by the appended claims.

I claim:

1. In a steering device for an outboard motor or the like comprising a first member adapted to be affixed to a vessel, a second member journalled for steering movement relative to said first member, the improvement comprising releasable means for releasably restraining said second member against steering movement relative to said first member comprising a pair of positively interengaging elements cooperating to prevent steering movement of said second member relative to said first member upon normal forces being exerted to said second member and to release the interengagement between said elements upon the exertion of greater than normal forces to said second member, said interengaging elements being positioned to interengage when said second member is only in a specific orientation relative to said first member and wherein said interengaging elements offer no resistance to steering movement when the second member is in other than that one position, and means for manually releasing the interengagement between the elements, comprising means for permitting one of the elements to be moved relative to its interengaged position with the other of the elements to a released position wherein said elements do not interengage and means for retaining said one element in its released position.

2. In a steering device as set forth in claim 1 wherein the interengaging elements reengage automatically upon return of the second member to the position in which it is to be restrained and when the one element is not in its released position.

3. In a steering device as set forth in claim 1 wherein the first member comprises a swivel bracket and the second member comprises a tiller, one of the elements being carried by one of the members and the other of the elements being carried by the other of the members.

4. In a steering device as set forth in claim 1 wherein one of the elements comprises a resilient member having an opening therein and the other of the members comprises a detent pin adapted to engage the opening.

5. In a steering device as set forth in claim 4 wherein the detent pin is rotatable between a first position and a second position and further including means for retaining said pin in a position to engage the opening in said resilient member when it is in its first position and to be spaced from said opening when said pin is in its second position and comprising the manual releasing means.

6. In a steering device as set forth in claim 5 further including biasing means for biasing said pin to its disengaged position.

7. In a steering device as set forth in claim 6 wherein the resilient member comprises a leaf spring and has a pair of downturned tabs on either side of said opening for engaging said pin and camming said leaf spring so that said pin may engage said opening in said leaf spring upon return of the second element to a predetermined steering position.

* * * * *